US007328996B2

(12) United States Patent
Walling

(10) Patent No.: US 7,328,996 B2
(45) Date of Patent: Feb. 12, 2008

(54) SENSOR AND INK-JET PRINT-HEAD ASSEMBLY AND METHOD RELATED TO SAME

(76) Inventor: Alex M. Walling, Lindevägen 128, 2tr, Enskede Gård (SE) S-120 48

( * ) Notice: Subject to any disclaimer, the term of this patent is extended or adjusted under 35 U.S.C. 154(b) by 0 days.

(21) Appl. No.: 10/483,521

(22) PCT Filed: Jul. 3, 2002

(86) PCT No.: PCT/SE02/01328

§ 371 (c)(1),
(2), (4) Date: Sep. 8, 2004

(87) PCT Pub. No.: WO03/006244

PCT Pub. Date: Jan. 23, 2003

(65) Prior Publication Data

US 2005/0018032 A1 Jan. 27, 2005

(30) Foreign Application Priority Data

Jul. 13, 2001 (SE) ..... 0102542

(51) Int. Cl.
*B41J 3/36* (2006.01)

(52) U.S. Cl. ..... 347/109; 400/88

(58) Field of Classification Search ..... 347/109; 400/88

See application file for complete search history.

(56) References Cited

U.S. PATENT DOCUMENTS

| | | | | |
|---|---|---|---|---|
| 4,631,400 | A | 12/1986 | Tanner et al. | |
| 5,644,139 | A | 7/1997 | Allen et al. | |
| 5,927,872 | A | 7/1999 | Yamada | |
| 6,233,368 | B1 | 5/2001 | Badyal et al. | |
| 6,357,939 | B1 * | 3/2002 | Baron | 400/88 |

FOREIGN PATENT DOCUMENTS

| | | | |
|---|---|---|---|
| DE | 195 19124 | A1 | 11/1996 |
| DE | 199 47 427 | | 4/2001 |
| EP | 0 730 366 | | 9/1996 |
| EP | 1 227 432 | A1 | 7/2002 |
| EP | 1 283 493 | | 2/2003 |
| WO | WO 01/74598 | | 10/2001 |
| WO | WO 03/006244 | A1 | 1/2003 |

OTHER PUBLICATIONS

Article 92 (2) EPC Communication from European Patent Office dated Mar. 13, 2007.

* cited by examiner

*Primary Examiner*—Julian D. Huffman
(74) *Attorney, Agent, or Firm*—Nixon & Vanderhye P.C.

(57) ABSTRACT

The invention relates to a sensor and ink-jet print-head assembly comprised in a housing for a hand-held and hand-operated printing device controlled by a processor, and a method therefore. It provides a control for navigation with coordinate systems and angles on a print medium that preferably is bigger than the assembly.

24 Claims, 6 Drawing Sheets

SENSOR AND INK-JET PRINT-HEAD ASSEMBLY AND METHOD RELATED TO SAME

This application is the U.S. national phase of international application PCT/SE02/01328, filed Jul. 3, 2002, which designated the U.S., the entire content of which is hereby incorporated by reference.

TECHNICAL FIELD

The present invention pertains to a sensor means and an ink-jet print-head assembly for a hand-held and hand-operated printing on a print medium controlled by a processor, and a method therefore, so called Random Movement Printing Technology (RMPT). Specifically it provides a new control to determine the position of the assembly on a print medium.

BACKGROUND ART

Hand-held and hand-operated printing devices with an ink-jet print-head are known through various documents.

U.S. Pat. No. 5,927,872 by Yamada discloses a system and a method of printing an image represented by a frame of image data utilizing a hand-held printer having optical sensor means for tracking positions of the hand-held printer relative to the surface of a print medium during a printing process. It is monitored in real time using navigation information generated by the optical sensor.

Each optical sensor comprises an array of opto-electronic elements to capture images of the surface of a print medium at fixed time intervals. Preferably, the optical sensor means can detect slight pattern variations on the print medium, such as paper fibers or illumination pattern formed by highly reflective surface features and shadowed areas between raised surface features.These features can then be used as references for determining the position and the relative movement of the hand-held printer. During the printing process, the printed portions of the image can also be used as reference positions by the hand-held printer.

In the preferred embodiment, the hand-held printer contains a navigation processor and a printer driver. Using the printer driver, the navigation processor drives the hand-held printer to print segments of the image onto a print medium as the hand-held printer travels across the print medium during a printing process. Each segment of the image is printed onto a particular location on the print medium to form a composite of the image.

In the U.S. Pat. No. 6,233,368 B1 by Badyal et al it is taught a CMOS digital integrated circuit (IC) chip on which an image is captured, digitized, and then processed on-chip in substantially the digital domain.

A preferred embodiment comprises imaging circuitry including a photo cell array for capturing an image and generating a representative analog signal, conversion circuitry including an n-bit successive approximation register (SAR) analog-to-digital converter for converting the analog signal to a corresponding digital signal, filter circuitry including a spatial filter for edge and contrast enhancement of the corresponding image, compression circuitry for reducing the digital signal storage needs, correlation circuitry for processing the digital signal to generate a result surface on which a minima resides representing a best fit image displacement between the captured image and previous images, interpolation circuitry for mapping the result surface into x- and y-coordinates, and an interface with a device using the chip, such as a hand-held scanner.

The filter circuitry, the compression circuitry, the correlation circuitry and the interpolation circuitry are all embodied in an on-chip digital signal processor (DSP). The DSP embodiment allows precise algorithmic processing of the digitized signal with almost infinite hold time, depending on storage capability. The corresponding mathematical computations are thus no longer subject to the vagaries of CMOS chip structure processing analog signals. Parameters may also be programmed into the DSP's software making the chip tunable, as well as flexible and adaptable for different applications.

U.S. Pat. No. 5,644,139 by Allen et al discloses a scanning device and a method for forming a scanned electronic image including the use of navigation information that is acquired along with image data, and then rectifying the image data based upon the navigation and image information. The navigation information is obtained in frames. The differences between consecutive frames are detected and accumulated, and this accumulated displacement value is representative of a position of the scanning device relative to a reference. The image data is then positioned-tagged using the position data obtained from the accumulated displacement value. To avoid the accumulation of errors, the accumulated displacement value obtained from consecutive frames is updated by comparing a current frame with a much earlier frame stored in memory and using the resulting difference as the displacement from the earlier frame. These larger displacement steps are then accumulated to determine the relative position of the scanning device.

The above documents do only teach how to determine the position in a conceptual generation of navigation information. In this context the U.S. Pat. No. 5,927,872 by Yamada uses the navigation information for a hand-held scanner disclosed in U.S. Pat. No. 5,644,139 by Allen et al. The invention according to Allen et al teaches navigation through comparison of pixels on a frame basis.

By analyzing the state of the art through the above documents a need of providing a navigation control through a coordinate system emerges, which does not need to compare prior position information with current position information for a hand-held printer.

SUMMARY OF THE DISCLOSED INVENTION

The present invention relates to a new sensor and an ink-jet print-head assembly for a hand-held and hand-operated printing on a print medium controlled by a processor and a method therefore. One aim of the present invention is to provide a new navigation control for print-outs accomplished by the assembly.

Hence, the present invention sets forth a sensor and an ink-jet print-head assembly comprised in a housing for a hand-held and hand-operated printing device controlled by a processor. Thereby it comprises:

two position sensor means at least one sensor means being related to a first coordinate system, having one axis in a relation to the print-head assembly, and one axis in a direction through both sensor means;

a print-head array attached in a fixed position to the sensor means;

input means on the housing connected to the processor for input of control commands;

determining means for reference coordinates in a second coordinate system provided in relation to a print medium, the reference coordinates being established by a control command through the input means with the thus read sensor means signals;

integrating means for keeping track of the assemblies position related to the reference coordinates in the second coordinate system by integrating displacement of sensor means position in the first coordinate system;

computing means for transforming the sensor means coordinates to coordinates in the second coordinate system, whereby the assemblies position on the print medium is determined in relation to the reference coordinates.

In one embodiment of the present invention a look-up table comprises normalized sensor steps with a predetermined resolution between sensor steps, one of the sensor steps determining a minimum movement of the assembly.

One embodiment comprises that a position is expressed through the coordinates of the sensor means and the angle between the prior position and the current position of the sensor means.

Another embodiment comprises that the transforming of the sensor means coordinates is derived through the position of the sensor means related to the first coordinate system and the angle of the print-head array in relation to the second coordinate system.

A further embodiment comprises that an angular change is computed as the difference of the sensor means movement in the y-direction of the first coordinate system multiplied with a constant which is determined in relation to the distance between the two sensor means.

A still further embodiment comprises that the print-head nozzle position is computed from the knowledge of the position of one sensor means and the tilt angle of the assembly, by calculating the position of the first and last nozzle in the array.

Yet one other embodiment comprises that remaining nozzle positions are computed by starting from the first nozzle positions and adding up the difference in x- and y-directions between the nozzles, whereby the x- and y-distance between the first and last nozzle is divided by the number of nozzles.

A yet further embodiment comprises that its width is smaller then the width of the print medium.

A still further embodiment comprises that a positioning means is provided to position the assembly in a correct starting position in relation to the print medium.

Yet another embodiment comprises that a, not visible for a human eye, pattern provided by injected ink-jet drops in even intervals is used as reference points to adjust for possible sensor means position dislocations.

Furthermore the present invention sets forth method for a sensor and ink-jet print-head assembly comprised in a housing for a hand-held and hand-operated printing device controlled by a computer processor. It comprises the steps of:

providing two position sensor means, whereby at least one sensor means being related to a first coordinate system, having one axis in a relation to the print-head assembly, and one axis in a direction through both sensor means;

providing a print-head array attached in a fixed position to the sensor means;

providing input means on the housing connected to the processor for input of control commands;

providing determining means for reference coordinates in a second coordinate system provided in relation to a print medium, the reference coordinates being established by a control command through the input means;

providing integrating means for keeping track of the assemblies position related to the reference coordinates in the second coordinate system by integrating displacement of sensor means position in the first coordinate system;

providing computing means for transforming the sensor means coordinates to coordinates in the second coordinate system, whereby the assemblies position on the print medium is determined in relation to the reference coordinates.

The method of the present invention is able to perform method steps of the above assembly embodiments in accordance with attached method sub-claims.

BRIEF DESCRIPTION OF THE DRAWINGS

Henceforth reference is had to the accompanying drawings for a better understanding of the given examples and embodiments of the present invention, wherein.

DETAILED DESCRIPTION OF PREFERRED EMBODIMENTS

The present invention discloses a hand-held printer device, which substitutes both the mechanical control of a print-head and forward feeding of a print-out through hand movements on a printing surface. This enables a manufacturing of a printer device, having less width than the actual print-out, and a reduction of the total of mechanical components in its construction.

It is designed to provide a compact portable printing device in order to enable a user to print from small portable devices such as a cellular phone, a portable PC, a personal digital assistance (PDA) or the like, and other portable electronic devices or for electronic stamping, printing of small texts, tags, addresses, cutting and clipping.

By fixing a print-head in a construction plate where one or more positioning sensor means are fixed as well, it is possible to obtain a geometrical construction with an x- and y-coordinate system and to establish, with great mathematical accuracy, the coordinates x and y for each individual ink-jet opening/nozzle in the print-head.

The coordinates, during a time frame, constitute the grounds for an accurate and precise spraying of ink-drops onto a printing surface according to a predetermined printing design. Even when the coordinates change over a time period, it is possible to calculate in real time, the changes in direction, speed, acceleration, rotation etc. along the z-axis controlled by a microprocessor. It provides the possibility to adjust the printing-head to spray an even and pre-programmed flow of ink-jet drops into an adjustable and varying flow of ink-jet drops.

Figure 1:
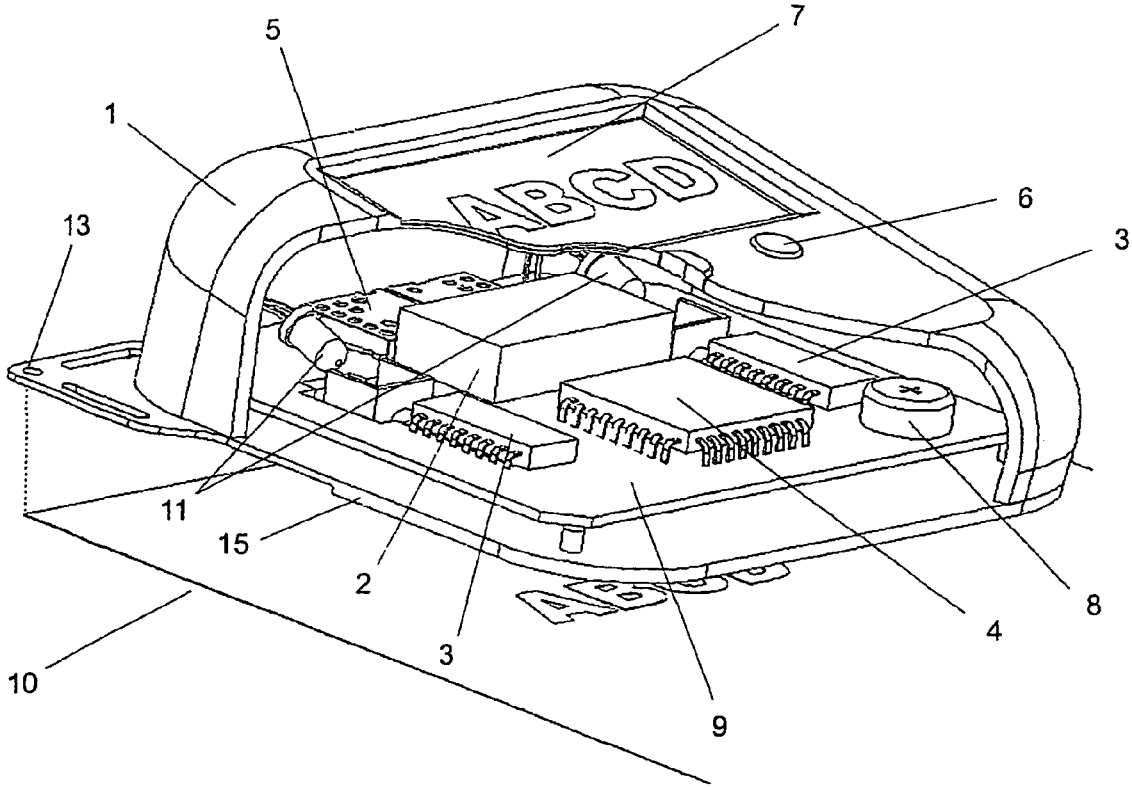
FIG. 1 illustrates a perspective view in section of a printing device according to the present invention.
Figure 2:
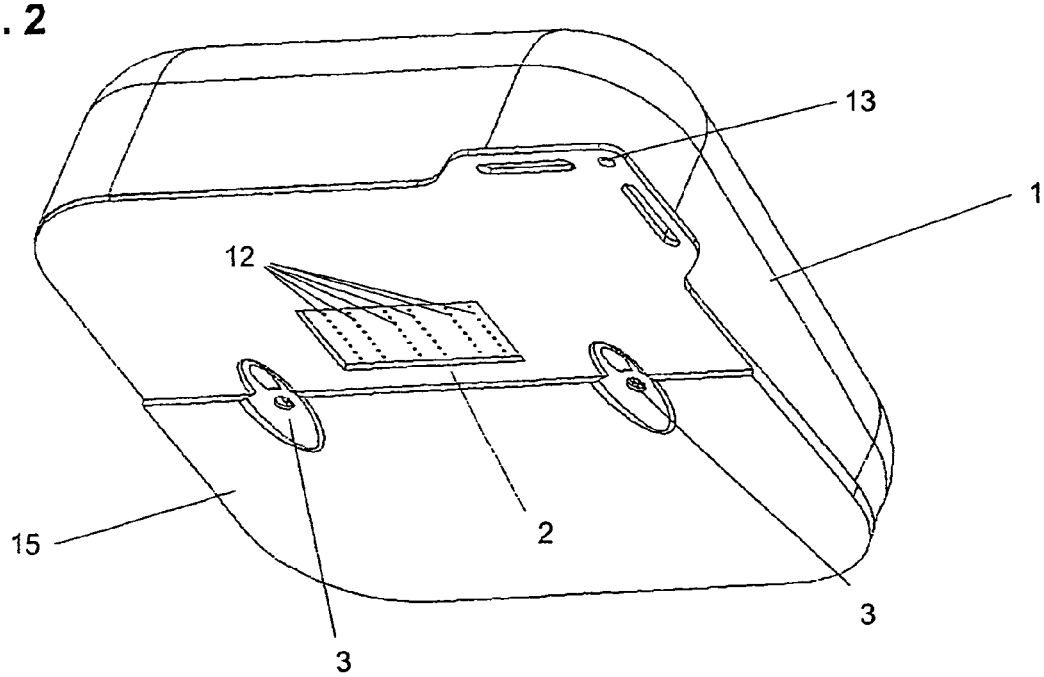
FIG. 2 illustrates a perspective view from underneath of a printing device according to the present invention.

FIGS. 1 and 2 illustrate a hand operated printing device composed by a construction/design body 1 and a print-head 2 which interact with one or more optical positioning sensor means 3, a micro controller circuit 4, a communication unit 5 to transmit the data, one or more command buttons 6 a control screen, and a source of energy, in this case a battery 8.

The embodiment according to FIGS. 1 and 2 illustrate the different components of a printing device fixed to a printed circuit card which simultaneously functions as a construction surface where those components are fixed. An elevation in the construction secures that the lowest surface of the printing device does not touch the area where the ink has been previously applied provided that the printing device is removed from that area.

The printing process starts with a data file containing pre-selected printing patterns, which are sent via the communication unit 5 to a data memory, for example, one which is built into the micro controller circuit 4. With the assistance of a built-in positioning means 13 and one of the command buttons 6, the coordinates are indicated to an outgoing point of reference in the printing surface. One or more sources of light, for example light emitting diodes (LED), lighting up the printing frame so that the optical positioning sensor means 3 are activated and then the forward feeding of the coordinates to the micro controller circuit can take place.

When the positioning sensor means 3 and the print-head 2 are fixed in relation to each other, a geometrical construction with all the necessary parameters for a mathematical calculation of the coordinates of the print-head 2 can be achieved.

The micro controller circuit 4 contains a software program, which uses the incoming data from the positioning sensor means 3 and mathematical equations to calculate in real time the coordinates for each individual ink-jet nozzle 12.

Using the measures of two coordinates establishes the required movement direction for each case. The time difference between two measurements indicates the acceleration and speed required. Simultaneously all measurements and equations are compared with the stored printing commands based upon coordinates equated from the original data file.

At this stage the micro controller circuit has sufficient information to seize a decision. On a positive indication an electric impulse is generated in the piezo- or termo-electrical micro pumps in the concerned ink-jet nozzles 12, which in turn sends out ink-jet drops onto the printing surface.

The printing commands are erased after each electric impulse so that even if the ink-jet nozzles coincide with the previous coordinates no ink drops are sent out to the existing print out.

Figure 3:
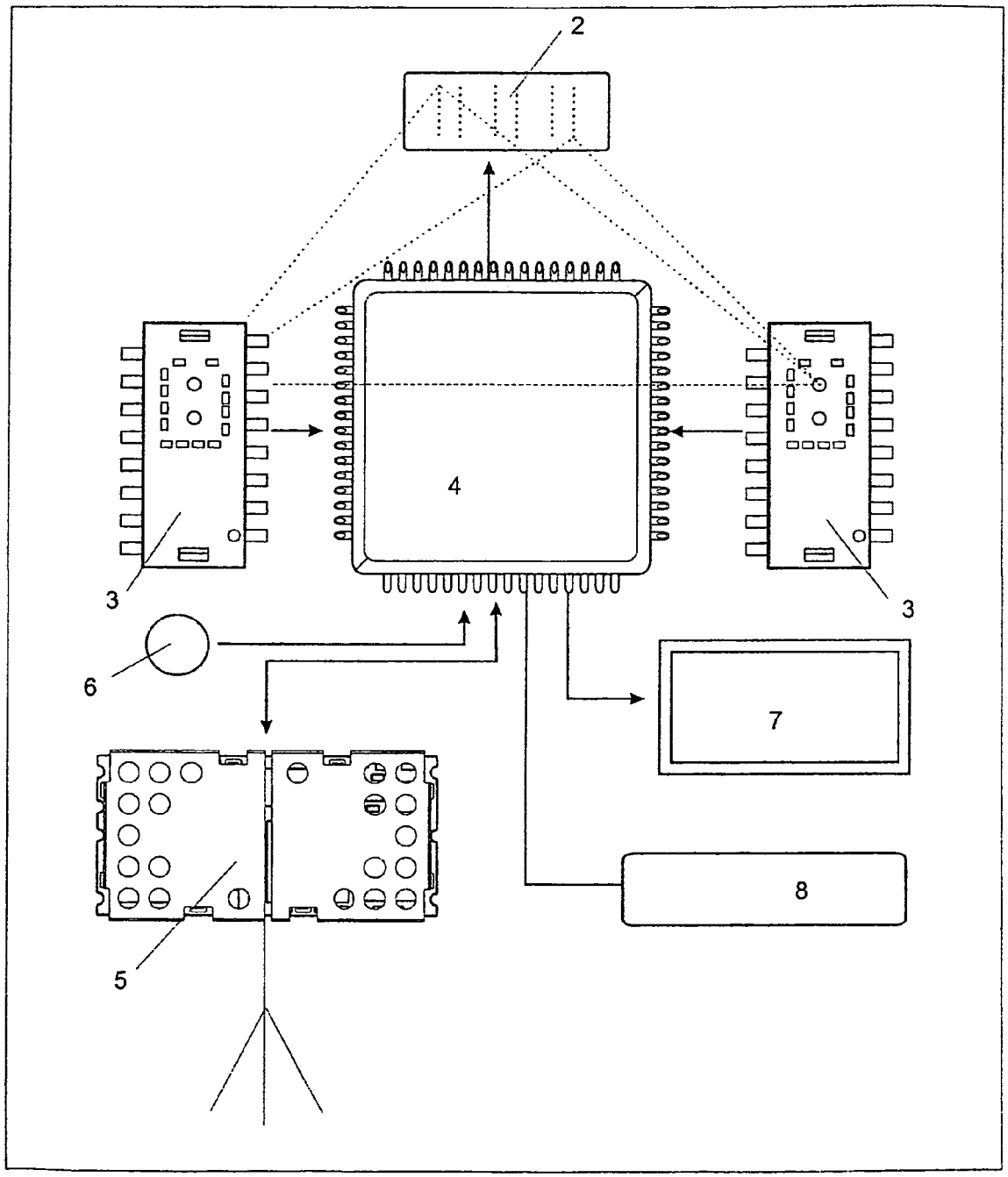
FIG. 3 illustrates a schematic view of the main components of a printing device according to the present invention.

FIG. 3 illustrates how the different components of the printing device interact as well as reproduction of the geometrical forms established between the ink-jet nozzles 12 and the positioning sensor means 3.

Figure 4:
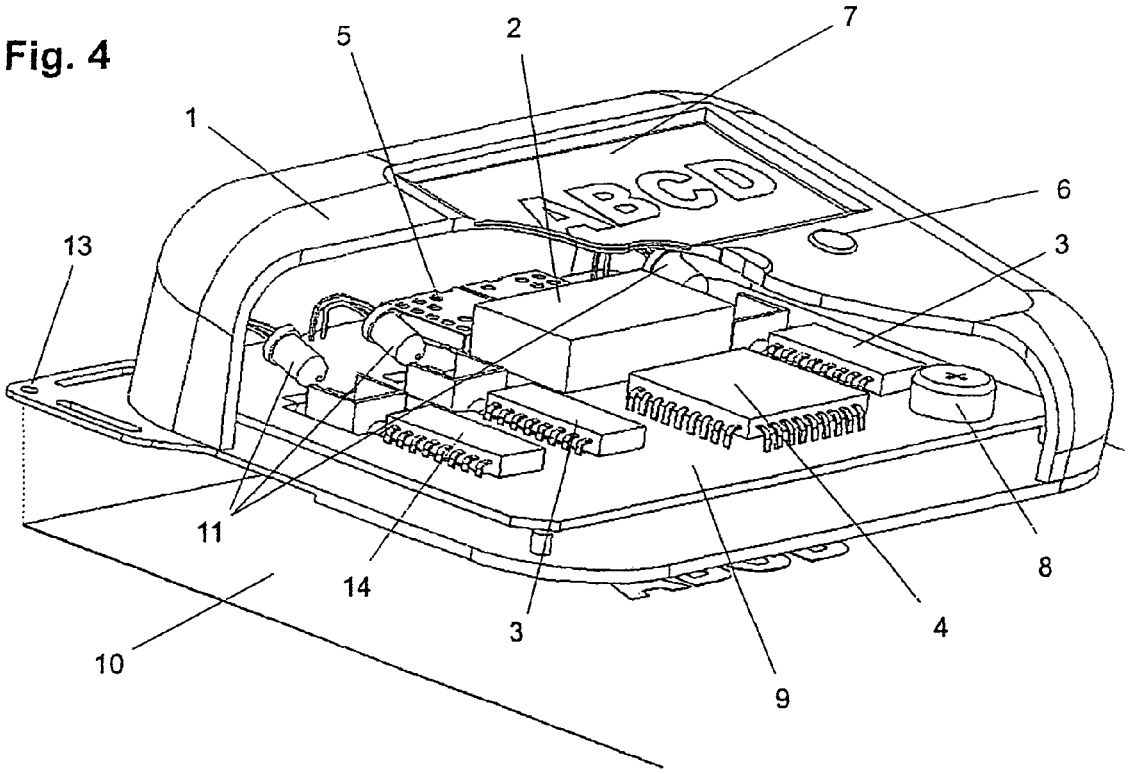
FIG. 4 illustrates a perspective view of another embodiment for a printing device according to the present invention.

The embodiment according to FIG. 4 illustrates the printing device with a complementary digital camera 14, for example, such as a CCD equipped camera.

The print-head 2 can be pre-programmed to send out, with even intervals small groups of separated microscopic ink-jet drops pairs, which do not belong to the actual printing pattern but which can build a recognizable pattern for the camera 14. The camera registers these dots and transmits the information onto the micro controller circuit 4 which uses the information as a reference for ongoing revision of the position of the printing device and in that way reduce the effect of the margin of error built-in the positioning sensor means 3. This embodiment is especially effective when printing on bigger surfaces as well as when the resolution and quality demands are high.

These groups of microscopic ink-drops are essentially invisible for the human eye and they do not affect the printing result in any noticeable way.

Figure 5:
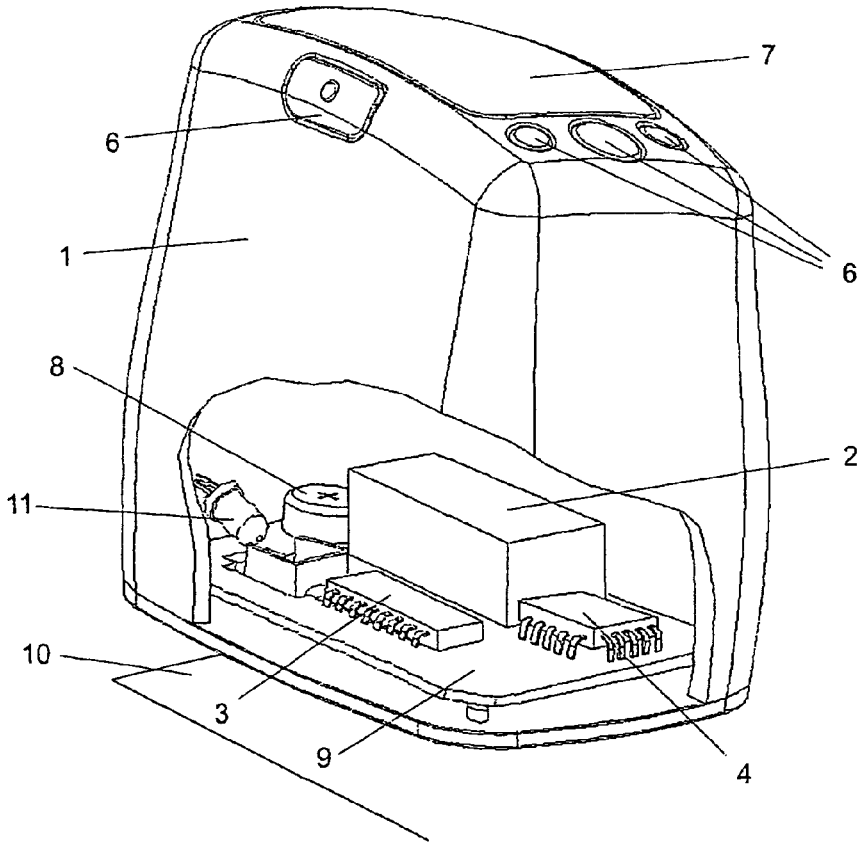
FIG. 5 illustrates a perspective view of a simpler printing device according to the present invention.

FIG. 5 illustrates another embodiment of the present invention for printing of smaller text quantities or graphics.

This can be considered as an electronic labeling with a pre-programmed and/or programmable electronic stamp pad.

In this embodiment only one positioning sensor means 3 is used and accordingly a simpler micro controller circuit 4 is needed, since the printing device only makes smaller and relatively straight movements.

Figure 6:
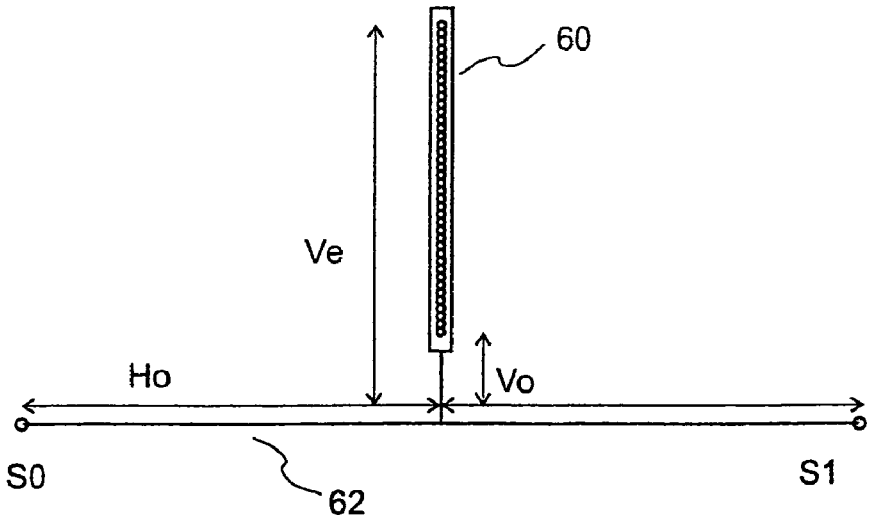
FIG. 6 illustrates a sensor/print-head assembly in accordance with the present invention.

The sensor/print-head device consists of two position sensor means S0, S1 and a print head array 60 mounted together as FIG. 6 illustrates. FIG. 6 illustrates further, the two sensor means S0 and S1 in a fixed relation to a print-head array 60 with ink-jet nozzles. Ho depicts the distance from the array 60 to the sensor means S0, here Ho is the same distance to the sensor means S1. Ve and Vo, indicate the distance to the upper most and the lover nozzle in the array 60, respectively. The sensor means S0, S1 provide a signal corresponding to movements in x- and y-directions in a first coordinate system fixed to the respective sensor means S0, S1. The sensor means S0, S1 are fixed so that their coordinate systems are parallel to each other. A software keeps track of the assembly's position and angle relative to the paper coordinate system by integrating the movements given by the sensor means signals.

The new positions given the differential movements of sensor means S0, S1 are calculated as follows.

All position changes given in the sensor means coordinate system must be transformed to position and angle of the sensor system in a paper or other print medium coordinate system, here named as a second coordinate system. Since the distance, 2Ho, between the two sensor means is fixed it is enough to know the position of one sensor means and the angle of the print head array relative to the second coordinate system.

Figure 7:
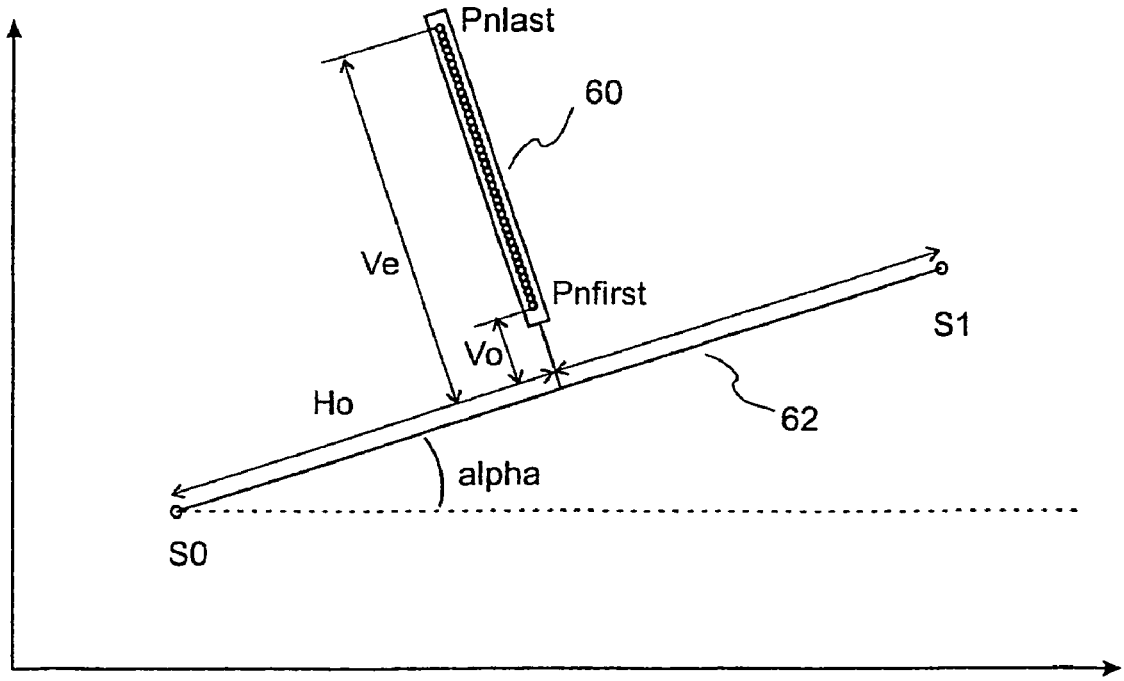
FIG. 7 illustrates a diagram with parameters used to determine the position of a sensor in accordance with the present invention.

Illustrated in FIG. 7, is a movement or navigation of the sensor print-head assembly according to FIG. 6. The array 60 has been moved or navigated an angle alpha. The upper most nozzle is depicted as Pnlast and the lower nozzle as Pnfirst, respectively, in FIG. 7. Also, the second coordinate system is depicted with the two longer arrow axis in FIG. 7.

In FIG. 7 at least one of the sensor means is assigned a first coordinate system, whereby one axis 62, preferably the x-axis, is directed through both sensor means S0, S1, and the other axis, preferably in a relation to the array 60, here in parallel to the array.

Figure 8:
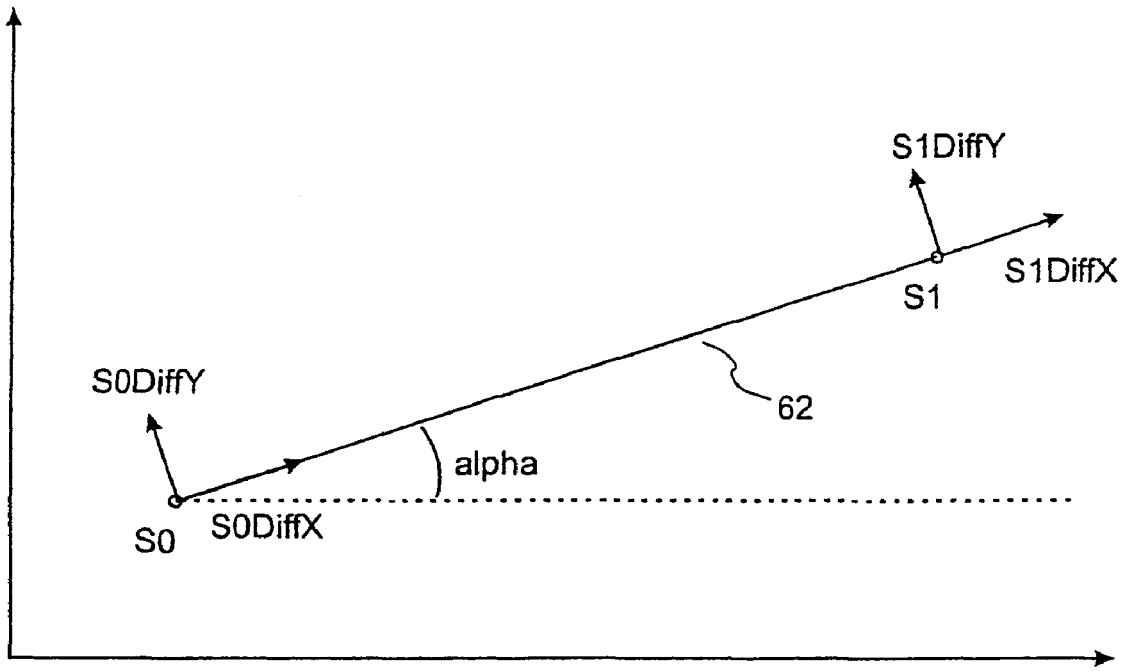
FIG. 8 illustrates a diagram with parameters for the print-head nozzle position in accordance with the present invention.

In FIG. 8, the same movement as in FIG. 7 is depicted, but without the array 60. The FIG. 8 further depicts a first coordinate system on the coordinate axis 60 directed through the both sensor means S0, S1. The first coordinate system, is in this embodiment duplicated, as indicated through the arrows on the axis 62, but as the distance between both sensor means S0, S1 is fixed only one of the first coordinate systems is needed for computation.

The movement of the sensor means S0 or S1 (it does not matter which one) in the paper or print medium second coordinate system at an angle 'alpha' is calculated, in accordance with the present invention, as:

$$\text{delta}X = S0\text{Diff}X^{*}\cos(\text{alpha}) - S0\text{Diff}Y^{*}\sin(\text{alpha})$$

$$\text{delta}Y = S0\text{Diff}X^{*}\sin(\text{alpha}) + S0\text{Diff}Y^{*}\cos(\text{alpha})$$

Where S0DiffX and S0DiffY are the movements of the sensor means in x- and y-directions respectively, in the sensor/print-head device, named first coordinate system.

The angular change can be calculated as the difference of the sensor means y-movements in the sensor means first coordinate system multiplied by a constant that is determined from the distance between the sensor means S0, S1. To simplify, the angle is measured in units of one sensor "step" and the sine and cosine values are taken from tables that are adjusted according to this. Thus S1DiffY−S0DiffY, provides the angle change.

The movement in x-direction of sensor means S1 is not used, the information is redundant since the sensor means geometry is fixed.

When the position of one sensor means S0 or S1 and the tilt angle of the sensor/print head assembly alpha are known the positions of the print head nozzles can be calculated as follows, depicted in FIG. 7:

The positions of the first and last nozzle are calculated as:

$$PN\text{first}X = S0x + Ho^{*}\text{cosine}(\text{alpha}) - Vo^{*}\text{sine}(\text{alpha})$$

$$PN\text{first}Y = S0y + Ho^{*}\text{sine}(\text{alpha}) + Vo^{*}\text{cosine}(\text{alpha})$$

$$PN\text{last}X = S0x + Ho^{*}\text{cosine}(\text{alpha}) - Ve^{*}\text{sine}(\text{alpha})$$

$$PN\text{last}Y = S0y + Ho^{*}\text{sine}(\text{alpha}) + Ve^{*}\text{cosine}(\text{alpha})$$

To calculate the positions of all nozzles, it is to start with the first nozzle positions and adding up the difference in x- and y-directions between the nozzles, calculated by dividing the x- and y-distance between the first and last nozzle by the number of nozzles:

$$PN(n)X = PN\text{first}X + n^{*}\text{delta}X$$

$$PN(n)Y = PN\text{last} + n^{*}\text{delta}Y$$

where $$\text{delta}X = PN\text{last}X - PN\text{first}Y$$

$$\text{delta}Y = PN\text{last}Y - Pn\text{first}Y$$

In accordance with the teaching herein, the present invention sets forth a sensor and ink-jet print-head 2 assembly comprised in a housing 1 for a hand-held and hand-operated printing device controlled by a processor 4. It thus comprises:

two position sensor means S0, S1 at least one sensor means being related to a first coordinate system, having one axis in a relation to the print-head assembly, and one axis 62 in a direction through both sensor means;

a print-head array 60 attached in a fixed position to the sensor means S0, S1;

input means 6 on the housing connected to the processor for input of control commands;

determining means for reference coordinates in a second coordinate system provided in relation to a print medium, the reference coordinates being established by a control command through the input means 6 with the thus read sensor means signals;

integrating means for keeping track of the assemblies position related to the reference coordinates in the second coordinate system by integrating displacement of the sensor means position in the first coordinate system;

computing means for transforming the sensor means S0, S1 coordinates to coordinates in the second coordinate system, whereby the assemblies position on the print medium is determined in relation to the reference coordinates.

Sensor means and print-heads that are suitable for the present invention are well known in the art and described in for example U.S. Pat. No. 5,927,872 by Yamada, U.S. Pat. No. 6,233,368 B1 by Badyal et al, and U.S. Pat. No. 5,644,139 by Allen et al. Sensor means can be bought from Agilent, www.agilent.com. Another sensor means has the product name HDNS-2000 and enables 1.500 pitures/s, the next model in progress enables 6.000 pictures/s. Sensor means in this description can comprise known means that are to cooperate together with a sensor itself, for example, LEDs or only be sensors or an array of sensors.

Figure 9:
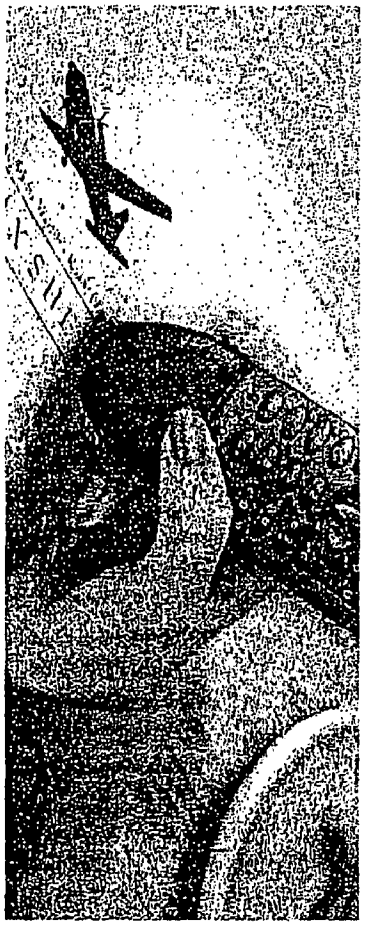
FIG. 9 illustrates an image to be print out.
Figure 10:
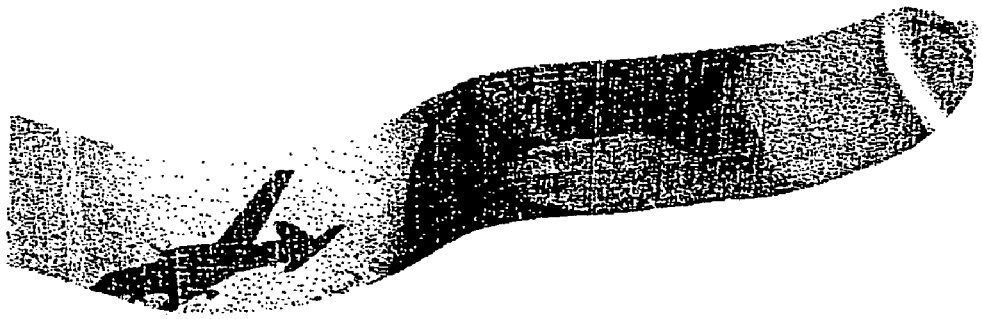
FIG. 10 illustrates a part random print out of the image with the printer according to the present invention.

FIG. 9 illustrates an image to be print out with the assembly of the present invention, thus stored in the assembly's memory, and FIG. 10 depicts a part print out in a random movement accomplished by the present invention. An assembly in accordance with the present invention relates to Random Movement Printing Technology (RMT).

It is appreciated that the means used in the present invention are hardware means or software means or a combination of both.

The present invention is not restricted to given embodiments or examples, but the attached set of claims define other embodiments for a person skilled in the art.

The invention claimed is:

1. A sensor and ink-jet print-head assembly comprised in a housing for a hand-held and hand-operated printing device controlled by a processor, comprising:

two position sensors, at least a first sensor being related to a first coordinate system, having one axis in a relation to a print-head array, arranged in a fixed position relative to said sensors, and one axis in a direction through both sensors;

at least one input control on said housing and connected to said processor to input control commands;

a coordinate determining routine associated with the processor to determine reference coordinates in a second coordinate system provided in relation to a print medium, said reference coordinates being established by a control command input through said input control and based on a sensor signal;

a position calculating routine associated with the processor to track the assembly's position related to said reference coordinates in said second coordinate system by integrating displacement of at least one sensor position in the first coordinate system; and a transform routine associated with the processor to transform the sensor coordinates to position coordinates in the second coordinate system, whereby the assembly's position on the print medium is determined in relation to the reference coordinates, said transform routine being operable to derive said transformation of the sensor coordinates, through the position of the first sensor related to the first coordinate system and an angle of the print-head array in relation to the second coordinate system, and to derive the angle of the print-head array in relation to the second coordinate system as the difference of the sensor movement in the y-direction of the first coordinate system multiplied with a constant which is determined in relation to the distance between the two sensors.

2. An assembly according to claim 1, wherein the transformation routine is configured to express a position through the sensor coordinates and the angle between the prior sensor position and the current sensor position.

3. An assembly according to claim 1, further including a print head position calculating routine associated with the processor operable to calculate a print-head nozzle position from one sensor position and the angle of the assembly, by calculating the position of a first and last nozzle in said array.

4. An assembly according to claim 3, wherein the print head position calculating routine is operable to calculate remaining nozzle positions by starting from the first nozzle positions and adding up the difference in x- and y-directions between the nozzles, whereby the x- and y-distance between the first and last nozzle is divided by the number of nozzles.

5. An assembly according to claim 3, wherein the print head position calculating routine is operable to calculate remaining nozzle positions as follows:

$$PN(n)X=PN\text{first}X+n*\text{delta}X$$

$$PN(n)Y=PN\text{last}+n*\text{delta}Y$$

where $$\text{delta}X=PN\text{last}X-PN\text{first}Y$$

$$\text{delta}Y=PN\text{last}Y-Pn\text{first}Y.$$

6. An assembly according to claim 1, further including a print head position calculating routine associated with the processor to calculate print-head nozzle positions as follows:

$$PN\text{first}X=S0x+Ho*\text{cosine(alpha)}-Vo*\text{sine(alpha)};$$

$$PN\text{first}Y=S0y+Ho*\text{sine(alpha)}+Vo*\text{cosine(alpha)};$$

$$PN\text{last}X=S0x+Ho*\text{cosine(alpha)}-Ve*\text{sine(alpha)}; \text{ and}$$

$$PN\text{last}Y=S0y+Ho*\text{sine(alpha)}+Ve*\text{cosine(alpha)}.$$

7. An assembly according to claim 1, wherein a width of the assembly is smaller than a width of the print medium.

8. An assembly according to claim 1, wherein a positioning guide is provided to position the assembly in a correct starting position in relation to the print medium.

9. An assembly according to claim 1, including an adjustment sensor, wherein a, pattern provided by ink-jet drops ejected in even intervals defines reference points to adjust for possible sensor position dislocations, the pattern being substantially invisible to a human eye.

10. A sensor and ink-jet print-head assembly comprised in a housing for a hand-held and hand-operated printing device controlled by a processor, comprising:

two position sensors, at least a first sensor being related to a first coordinate system, having one axis in a relation to a print-head array, arranged in a fixed position relative to said sensors, and one axis in a direction through both sensors;

at least one input control on said housing and connected to said processor to input control commands;

a coordinate determining routine associated with the processor to determine reference coordinates in a second coordinate system provided in relation to a print medium, said reference coordinates being established by a control command input through said input control and based on a sensor signal;

a position calculating routine associated with the processor to keep track of the assembly's position related to said reference coordinates in said second coordinate system by integrating displacement of sensor position in the first coordinate system; and a transform routine associated with the processor to transform the sensor coordinates to position coordinates in the second coordinate system, whereby the assembly's position on the print medium is determined in relation to the reference coordinates, said transform routine being operable to calculate the sensor position in the second coordinate system at an angle 'alpha' as follows:

$$\text{delta}X=S0\text{Diff}X*\text{cos(alpha)}-S0\text{Diff}Y*\text{sin(alpha)};$$

$$\text{delta}Y=S0\text{Diff}X*\text{sin(alpha)}+S0\text{Diff}Y*\text{cos(alpha)}; \text{ and}$$

where S0DiffX and S0DiffY are the movements of at least one of the sensors in x- and y-directions respectively, in the first coordinate system.

11. An assembly according to claim 10, wherein said transform routine is operable to derive the angle of the print-head array in relation to the second coordinate system as the difference of the sensor movement in the y-direction of the first coordinate system multiplied with a constant which is determined in relation to the distance between the two sensors.

12. An assembly according to claim 10, further including a print head position calculating routine associated with the processor, operable to calculate a print-head nozzle position from at least one sensor position and the angle of the assembly, by calculating the position of a first nozzle and a last nozzle in said array.

13. A method for position calculation of a sensor and ink-jet print-head assembly comprised in a housing for a hand-held and hand-operated printing device controlled by a processor, said assembly including two position sensors, whereby at least a first sensor is related to a first coordinate system, having one axis in relation to a print-head array arranged in a fixed position in relation to said sensors and one axis in a direction through both sensors, said assembly further including at least one input control provided on said housing, the method comprising:

determining reference coordinates in a second coordinate system provided in relation to a print medium, said reference coordinates being established by a control command through said input control and based on a sensor signals;

tracking the assembly's position related to said reference coordinates in said second coordinate system by integrating displacement of sensor position in the first coordinate system; and transforming the sensor coordinates to position coordinates in the second coordinate system, whereby the assembly's position on the print medium is determined in relation to the reference coordinates, by deriving a transformation of the first sensor coordinates, through the position of the first sensor related to the first coordinate system and an angle of the print-head array in relation to the second coordinate system, and deriving an angle of the print-head array in relation to the second coordinate system as the difference in sensor movement in the y-direction of the first coordinate system multiplied with a constant which is determined in relation to the distance between the two sensors.

14. A method according to claim 13, wherein a position is expressed through the sensor coordinates and the angle between the prior sensor position and the current sensor position.

15. A method according to claim 13, further comprising computing a print-head nozzle position from at least one sensor position and the angle of the assembly, by calculating the position of a first nozzle and a last nozzle in said array.

16. A method according to claim 15, wherein the computing includes computing remaining nozzle positions by starting from the first nozzle positions and adding up the difference in x- and y-directions between the nozzles, whereby the x- and y-distance between the first and last nozzle is divided by the number of nozzles.

17. A method according to claim 16, wherein the computing includes calculating remaining nozzle positions as follows:

$$PN(n)X=PN\text{first}X+n*\text{delta}X$$

$$PN(n)Y=PN\text{last}+n*\text{delta}Y$$

where $$\text{delta}X=PN\text{last}X-PN\text{first}Y$$

$$\text{delta}Y=PN\text{last}Y-Pn\text{first}Y.$$

18. A method according to claim 13, further comprising calculating print-head nozzle positions as follows:

$$PN\text{first}X=S0x+Ho*\text{cosine(alpha)}-Vo*\text{sine(alpha)};$$

$$PN\text{first}Y=S0y+Ho*\text{sine(alpha)}+Vo*\text{cosine(alpha)};$$

$$PN\text{last}X=S0x+Ho*\text{cosine(alpha)}-Ve*\text{sine(alpha)}; \text{ and}$$

$$PN\text{last}Y=S0y+Ho*\text{sine(alpha)}+Ve*\text{cosine(alpha)}.$$

19. A method according to claim 13, wherein a width of the assembly is smaller than a width of the print medium.

20. A method according to claim 13, further comprising positioning the assembly in a correct starting position in relation to the print medium.

21. A method according to claim 13, further comprising ejecting ink-jet drops in even intervals as a reference to adjust for possible sensor position dislocations, said pattern being substantially invisible a human eye.

22. A method for position calculation of a sensor and ink-jet print-head assembly comprised in a housing for a hand-held and hand-operated printing device controlled by a processor, said assembly including two position sensors, whereby at least a first sensor is related to a first coordinate system, having one axis in relation to a print-head array arranged in a fixed position in relation to said sensors, and one axis in a direction through both sensors, said assembly further including at least one input control provided on said housing, the method comprising:

determining reference coordinates in a second coordinate system provided in relation to a print medium, said reference coordinates being established by a control command through said input control and based on a sensor signal;

tracking the assembly's position related to said reference coordinates in said second coordinate system by integrating displacement of sensor position in the first coordinate system; and transforming the sensor coordinates to position coordinates in the second coordinate system, whereby the assembly's position on the print medium is determined in relation to the reference coordinates, by calculating the position of the sensor means in the second coordinate system at an angle 'alpha' as follows:

$$\text{delta}X=S0\text{Diff}X*\cos(\text{alpha})-S0\text{Diff}Y*\sin(\text{alpha});$$

$$\text{delta}Y=S0\text{Diff}X*\sin(\text{alpha})+S0\text{Diff}Y*\cos(\text{alpha}); \text{ and}$$

where S0DiffX and S0DiffY are movements of the sensors in x- and y-directions respectively, in the first coordinate system.

23. A method according to claim 22, wherein said transforming includes deriving the angle of the print-head array in relation to the second coordinate system as the difference in sensor movement in the y-direction of the first coordinate system multiplied with a constant which is determined in relation to the distance between the two sensors.

24. A method according to claim 22, further comprising computing a print-head nozzle position from at least one sensor position and the angle of the assembly, by calculating the position of a first nozzle and a last nozzle in said array.

* * * * *